US009310760B2

(12) United States Patent
Ichikawa

(10) Patent No.: US 9,310,760 B2
(45) Date of Patent: Apr. 12, 2016

(54) IMAGE FORMING APPARATUS WITH IMPROVED FEELING WHEN OPENING COVER

(75) Inventor: Hiroshi Ichikawa, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1059 days.

(21) Appl. No.: 12/562,716

(22) Filed: Sep. 18, 2009

(65) Prior Publication Data

US 2010/0080620 A1 Apr. 1, 2010

(30) Foreign Application Priority Data

Sep. 29, 2008 (JP) ..... 2008-250757

(51) Int. Cl.

| | |
|---|---|
| ***G03G 21/00*** | (2006.01) |
| ***G03G 21/18*** | (2006.01) |
| ***G03G 15/00*** | (2006.01) |
| ***G03G 21/16*** | (2006.01) |

(52) U.S. Cl.

CPC ..... *G03G 21/1842* (2013.01); *G03G 15/6514* (2013.01); *G03G 21/1633* (2013.01); *G03G 2215/00392* (2013.01); *G03G 2221/1687* (2013.01); *G03G 2221/1869* (2013.01)

(58) Field of Classification Search

CPC ..... G03G 21/1842; G03G 21/1633; G03G 2221/1687; G03G 15/6514; G03G 2215/00392

USPC ..... 399/392, 114, 380, 391, 393, 405

See application file for complete search history.

(56) References Cited

U.S. PATENT DOCUMENTS

2006/0029417 A1 2/2006 Kawamata et al.

FOREIGN PATENT DOCUMENTS

| | | | | |
|---|---|---|---|---|
| JP | 01-162355 | H | | 11/1989 |
| JP | 01-162355 | U | | 11/1989 |
| JP | 7-199767 | A | | 8/1995 |
| JP | 8-006458 | A | | 1/1996 |
| JP | 10-252740 | A | | 9/1998 |
| JP | 10252740 | A | * | 9/1998 |
| JP | 2002-356235 | | | 12/2002 |
| JP | 2006-047569 | A | | 2/2006 |
| JP | 2008-003402 | | | 1/2008 |
| JP | 2008-139435 | | | 6/2008 |

OTHER PUBLICATIONS

CN Office Action dated Oct. 18, 2011, corresponding Application No. 200910179554.1; English Translation.

JP Office Action dtd Aug. 3, 2010, JP Appln. 2008-250757, partial English Translation.

* cited by examiner

*Primary Examiner* — Blake A Tankersley

(74) *Attorney, Agent, or Firm* — Banner & Witcoff, Ltd.

(57) ABSTRACT

An image forming apparatus which forms an image with an image forming section includes: a casing in which the image forming section is arranged; a cover which is displaceably attached to the casing; a first elastic portion which is elastically deformable, and which is provided on one of the casing and the cover, the first elastic portion having an engage-objective portion which is engageable with an engaging portion provided on the other of the casing and the cover; and a second elastic portion which is elastically deformable, and which applies, to the first elastic portion, a force in a direction returning the first elastic portion to an original state when the first elastic portion is deformed.

10 Claims, 15 Drawing Sheets

IMAGE FORMING APPARATUS WITH IMPROVED FEELING WHEN OPENING COVER

CROSS REFERENCE TO RELATED APPLICATION

The present application claims priority from Japanese Patent Application No. 2008-250757, filed on Sep. 29, 2008, the disclosure of which is incorporated herein by reference in its entirety.

BACKGROUND OF THE INVENTION

1. Field of the Invention

The present invention relates to an image forming apparatus.

2. Description of the Related Art

In a paper feeder disclosed in Japanese Patent Application Laid open No. 2002-356235, in order to prevent a paper feeding tray in the shape of an opening/closing cover from being accidentally opened, for example, snap fit parts are provided on both side surfaces of the paper feeding tray, and at widthwise center of the tip of the paper feeding tray, a protrusion to be engaged with an upper exterior cover is provided.

In recent years, there has arisen a demand not only for a function but also for a good operating feeling which a user feels at the time of the opening/closing operation of a cover. Specifically, when an operating force is excessively great, the user has a bad operating feeling, and on the contrary, when the operating force is too small, the user feels that the cover is too easily opened and thus feels insecure to have a bad operating feeling.

Although the paper feeder disclosed in Japanese Patent Application Laid-open No. 2002-356235 prevents the cover (paper feeding tray) from being opened accidentally, the paper feeder has a difficulty in improving the operating feeling at the time of the opening/closing operation of the cover.

SUMMARY OF THE INVENTION

In view of the above, it is an object of the present invention to provide an image forming apparatus capable of improving an operating feeling when a cover is opened/closed.

According to a first aspect of the present invention, there is provided an image forming apparatus which forms an image with an image forming section, the apparatus including: a casing in which the image forming section is arranged; a cover which is displaceably attached to the casing; a first elastic portion which is elastically deformable, and which is provided on one of the casing and the cover, the first elastic portion having an engage-objective portion which is engageable with an engaging portion provided on the other of the casing and the cover; and a second elastic portion which is elastically deformable, and which applies, to the first elastic portion, a force in a direction returning the first elastic portion to an original state when the first elastic portion is deformed.

According to the first aspect of the present invention, by changing an elastic force of the first elastic portion and an elastic force of the second elastic portion, it is possible to easily change an operating force required for a user's opening/closing operation of the cover. Therefore, it is possible to easily improve the operating feeling.

Specifically, when it is felt that the operating force is too strong, reducing the elastic force of the second elastic portion can give a better operating feeling. On the other hand, when it is felt that the operating force is too light, increasing the elastic force of the second elastic portion can give a better operating feeling. Therefore, it is possible to easily improve the operating feeling.

Here, the elastic force refers to a stress (restoring force) when a predetermined distortion enabling elastic deformation occurs, and as the distortion, an amount when the deformation of the first elastic portion becomes largest by the opening/closing of the cover is adoptable, for instance.

DETAILED DESCRIPTION OF THE PREFERRED EMBODIMENTS

In this embodiment, the image forming apparatus according to the present invention is applied to an electrophotographic image forming apparatus. Hereinafter, the embodiment of the present invention will be described with reference to the drawings.

Figure 1:
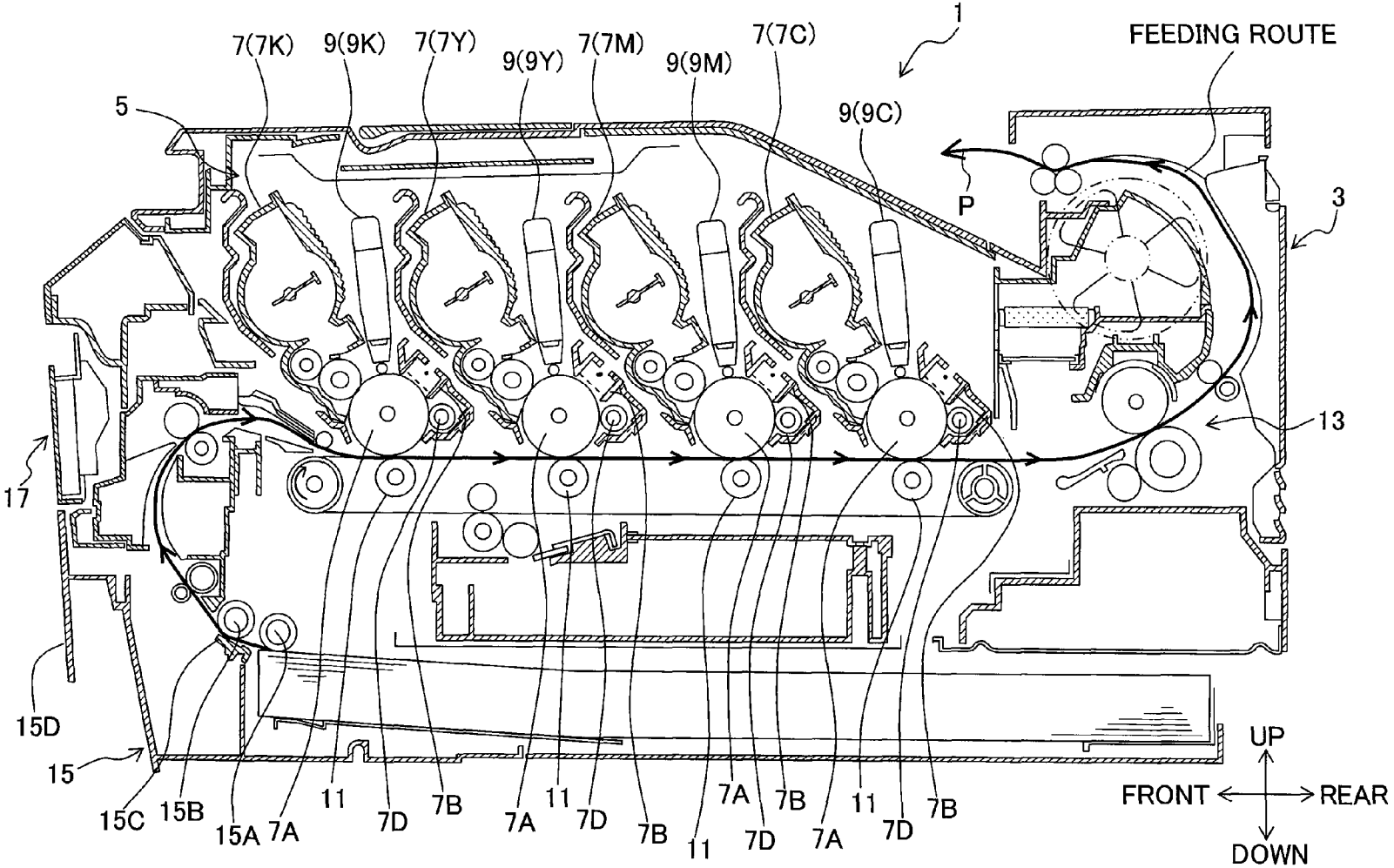
FIG. 1 is a central sectional view showing a schematic structure of an image forming apparatus according to an embodiment.

First, the structure of the image forming apparatus will be described. As shown in FIG. 1, a casing 3 of the image forming apparatus 1 houses an electrophotographic image forming part 5 which transfers a developer image to a recording sheet (hereinafter, referred to as paper) such as a recording paper or an OHP sheet to form an image on the paper.

The image forming part 5 includes, as is generally known, a process cartridge 7, an exposure unit 9 exposing a photosensitive drum 7A (to be described later), a transfer roller 11 transferring the developer image formed on the photosensitive drum 7A to the paper, and a fuser 13 thermally fixing the developer image transferred to the paper, and so on.

The image forming part 5 according to this embodiment is a direct tandem type having a plurality of (four in this embodiment) process cartridges 7K, 7Y, 7M, 7C arranged in series along a paper feeding direction and transfers a plural kinds of developer images directly to the paper.

Each of the process cartridges 7K, 7Y, 7M, 7C includes the photosensitive drum 7A carrying the developer image, a charger 7B charging the photosensitive drum 7A, a cleaner 7D cleaning a surface of the photosensitive drum 7A after the developer image on the surface has been transferred, and so on.

Further, the exposure unit 9 is composed of four exposure units 9K, 9Y, 9M, 9C corresponding to the process cartridges 7K, 7Y, 7M, 7C respectively, and each of the exposure units 9K, 9Y, 9M, 9C has a large number of LEDs being arranged parallel to an axial direction of the photosensitive drum 7A and exposes the photosensitive drum 7A by controlling ON/OFF of the LEDs.

Further, a paper feeding cassette 15 is a paper feeding tray on which papers to be transported to the image forming part 5 are placed in a stacked state, and the paper feeding cassette 15 is detachably mounted to the apparatus main body (casing 3).

Incidentally, after being transported toward the image forming part 5 by a pickup roller 15A, the papers placed on the paper feeding cassette 15 are separated one by one by a separating roller 15B and a separating pad 15C to be carried to the image forming part 5.

Figure 2:
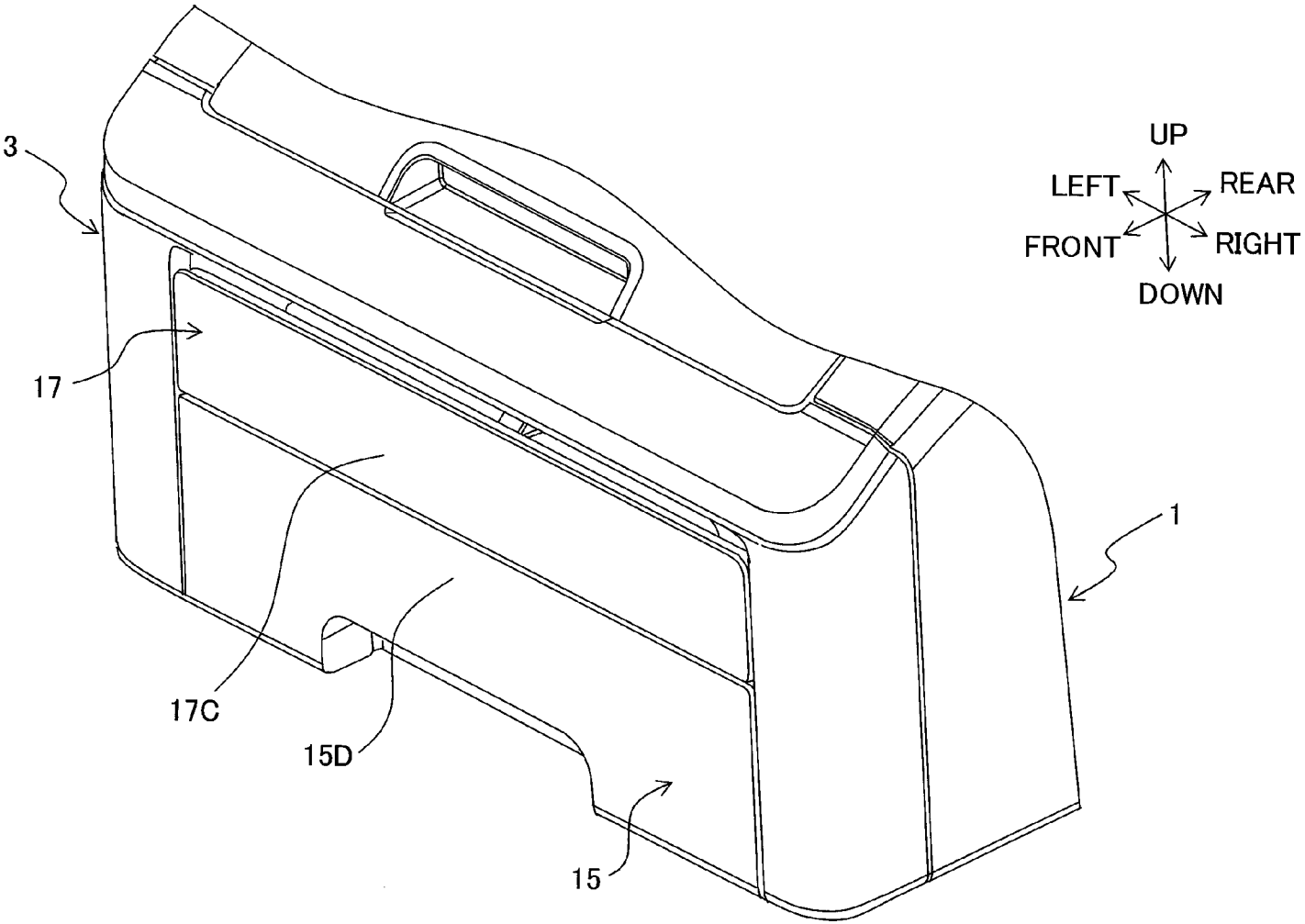
FIG. 2 is a view showing a state in which a manual feeding tray is closed.

Further, as shown in FIG. 2, a front surface portion 15D of the paper feeding cassette 15 forms a front design surface of the image forming apparatus 1, and on an upper side of the front surface portion 15D, a manual feeding tray 17 which is attached pivotally to the casing 3 is provided.

Figure 3:
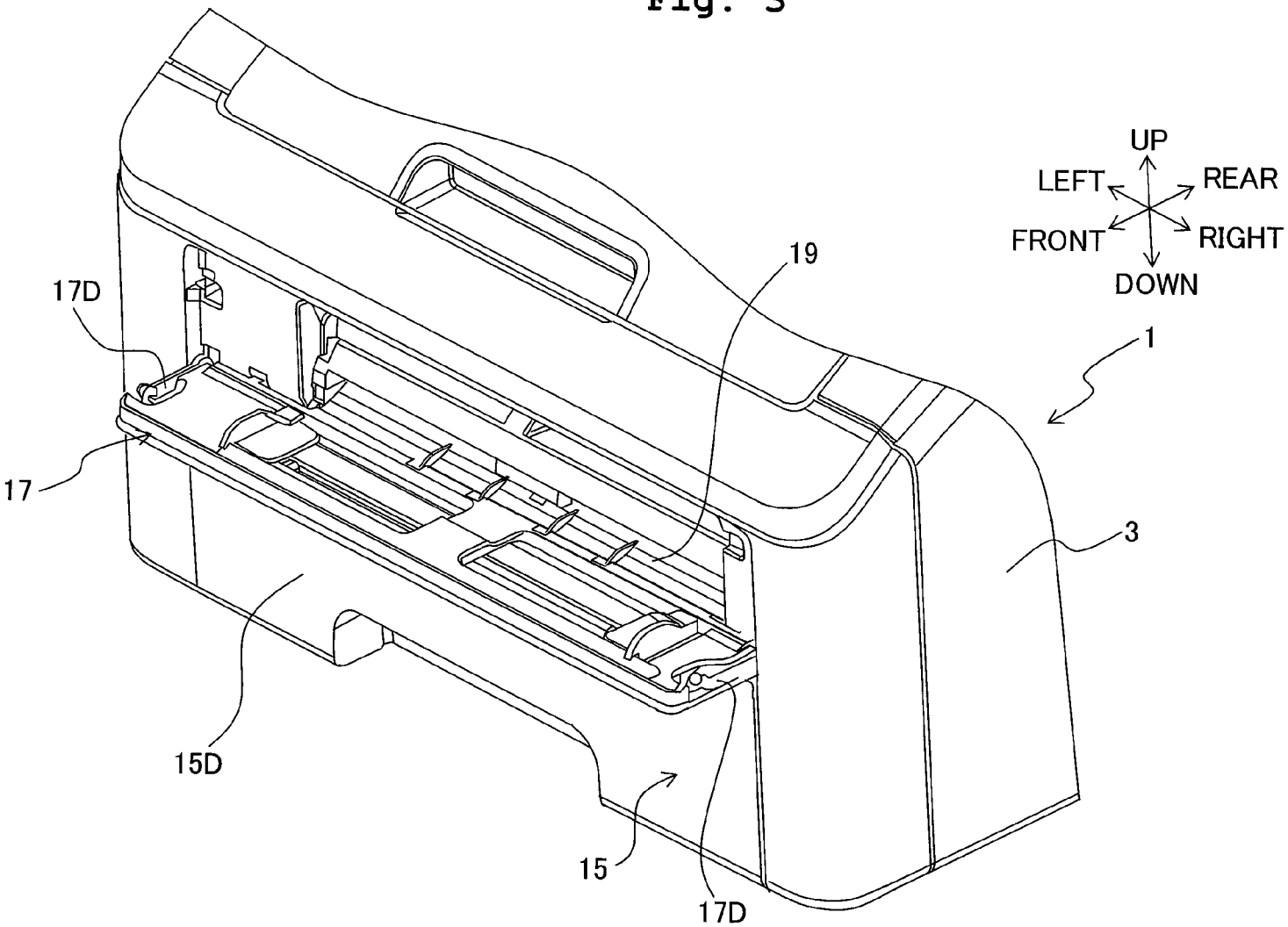
FIG. 3 is a view showing a state in which the manual feeding tray is opened.

As shown in FIG. 3, when the manual feeding tray 17 is opened to a front surface side, a manual paper feeding port 19 for feeding, directly to the image forming part 5, papers other than the papers placed on the paper feeding cassette 15 is opened and the manual feeding tray 17 functions as a guide member for the paper which is to be fed to the manual paper feeding port 19.

Figures 4A, 4B:
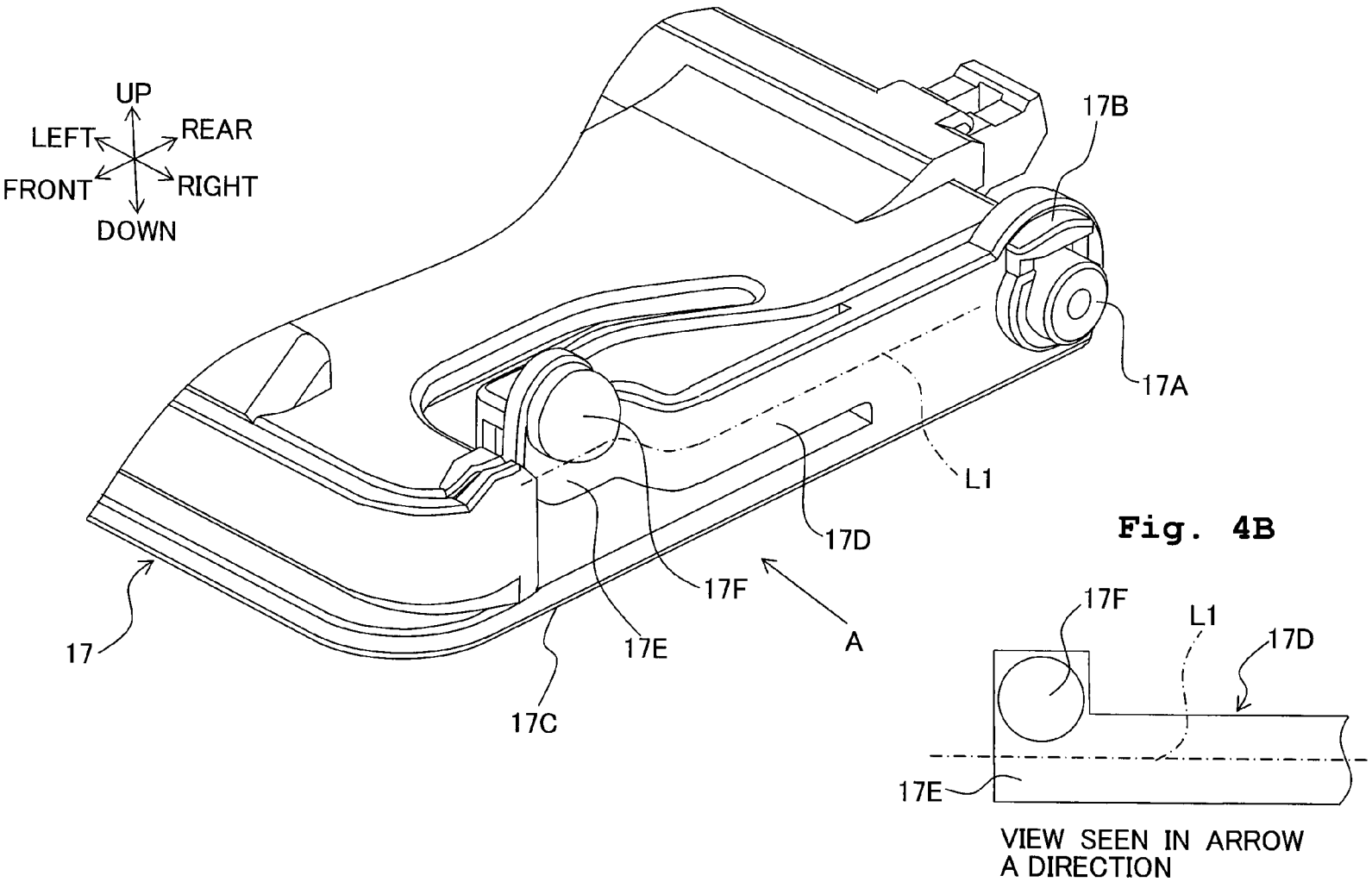
FIG. 4A is an enlarged view showing the vicinity of a pivot shaft of the manual feeding tray.
FIG. 4B is a view seen in the arrow A direction in FIG. 4A.

As shown in FIG. 3, the manual feeding tray 17 is formed in a band plate shape extending in a right and left direction (width direction) of the image forming apparatus 1. As shown in FIG. 4A, at lower portions of both end sides in a longitudinal direction of the manual feeding tray 17, pivot shafts 17A which pivotally support the manual feeding tray 17 are provided.

Here, "the lower portions (lower end sides) of the manual feeding tray 17" are "the lower portions (lower end sides) of the manual feeding tray 17" when the manual feeding tray 17 is in a closed state (see FIG. 2), and "upper end sides of the manual feeding tray 17" are "upper end sides of the manual feeding tray 17" when the manual feeding tray 17 is in the closed state (see FIG. 2).

Figure 5:
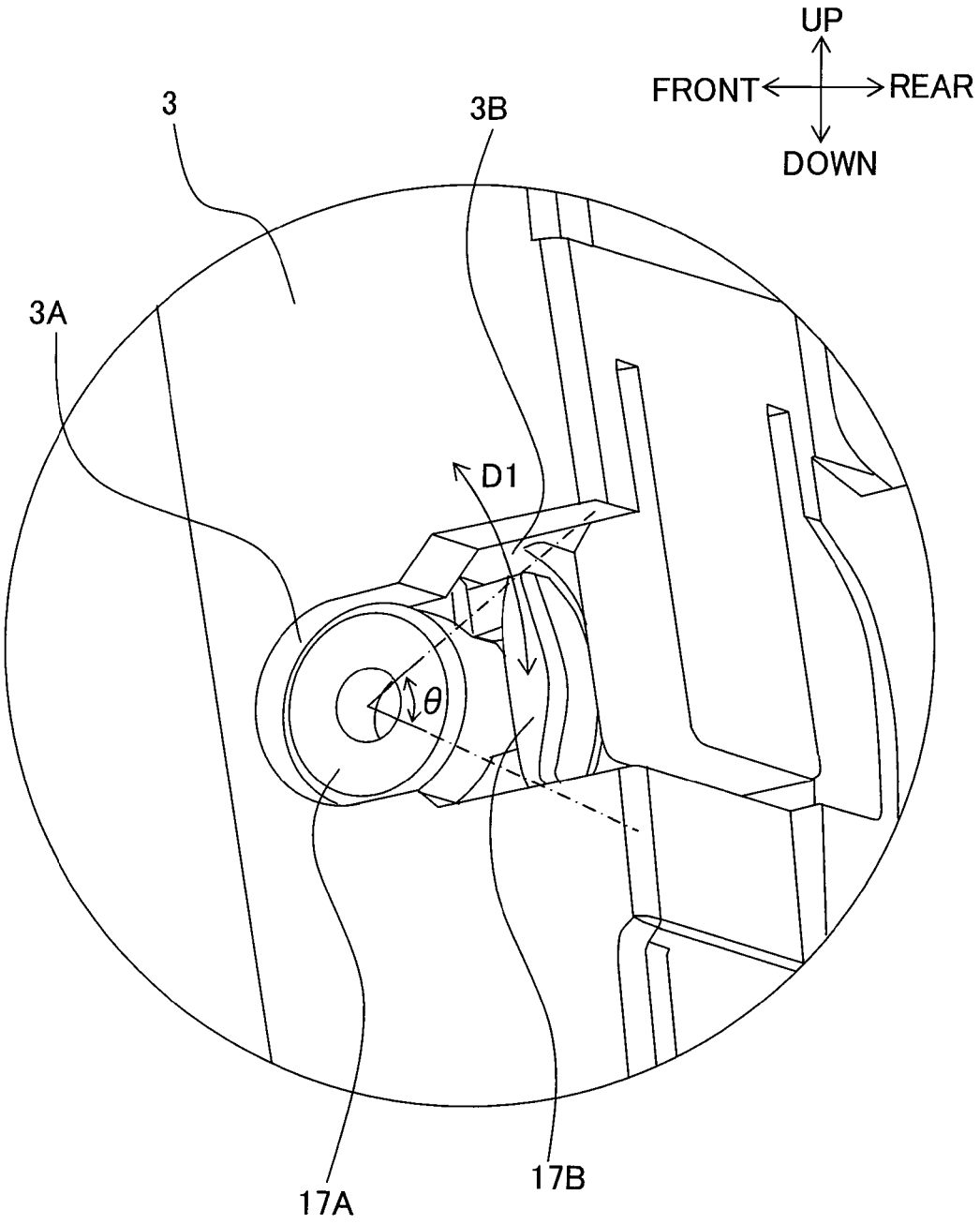
FIG. 5 is a view showing a state in which the pivot shaft and a hole portion are mated with each other.

Incidentally, the pivot shafts 17A are columnar boss portions protruding outward from an outer peripheral edge of the manual feeding tray 17, and as shown in FIG. 5, the pivot shafts 17A are rotatably buried in holes 3A in a U-groove shape provided in the casing 3.

Further, at portions which are located near the pivot shafts 17A and are located on a side of the image forming part 5 (rear side) of the pivot shafts 17A when the manual feeding tray 17 is closed, braking projections 17B projecting outward from the outer peripheral edge of the manual feeding tray 17 are provided. The braking projections 17B are formed in a ridge shape extending along a pivot direction D1 within a predetermined pivot range θ with respect to the pivot shafts 17A.

When the manual feeding tray 17 is closed, the braking projections 17B are housed in the holes 3A in the U-groove shape (see FIG. 5), and when the manual feeding tray 17 is opened, the braking projections 17B come into contact with a frame surface 3B (see FIG. 6), of the casing 3, facing an outer peripheral surface of the manual feeding tray 17 to give a pivot resistance to the manual feeding tray 17.

Further, as shown in FIG. 3, on both end sides in the longitudinal direction of the manual feeding tray 17, there are provided first arms 17D in a cantilever shape. Each of the first arms 17D extends substantially parallel to a plate surface 17C (see FIG. 2) of the manual feeding tray 17 formed in the band plate shape. One end of each of the first arms 17D is fixed integrally to the manual feeding tray 17 and the other end extends from the pivot shaft 17A side (lower end side) to a tip side (upper end side).

Figure 6:
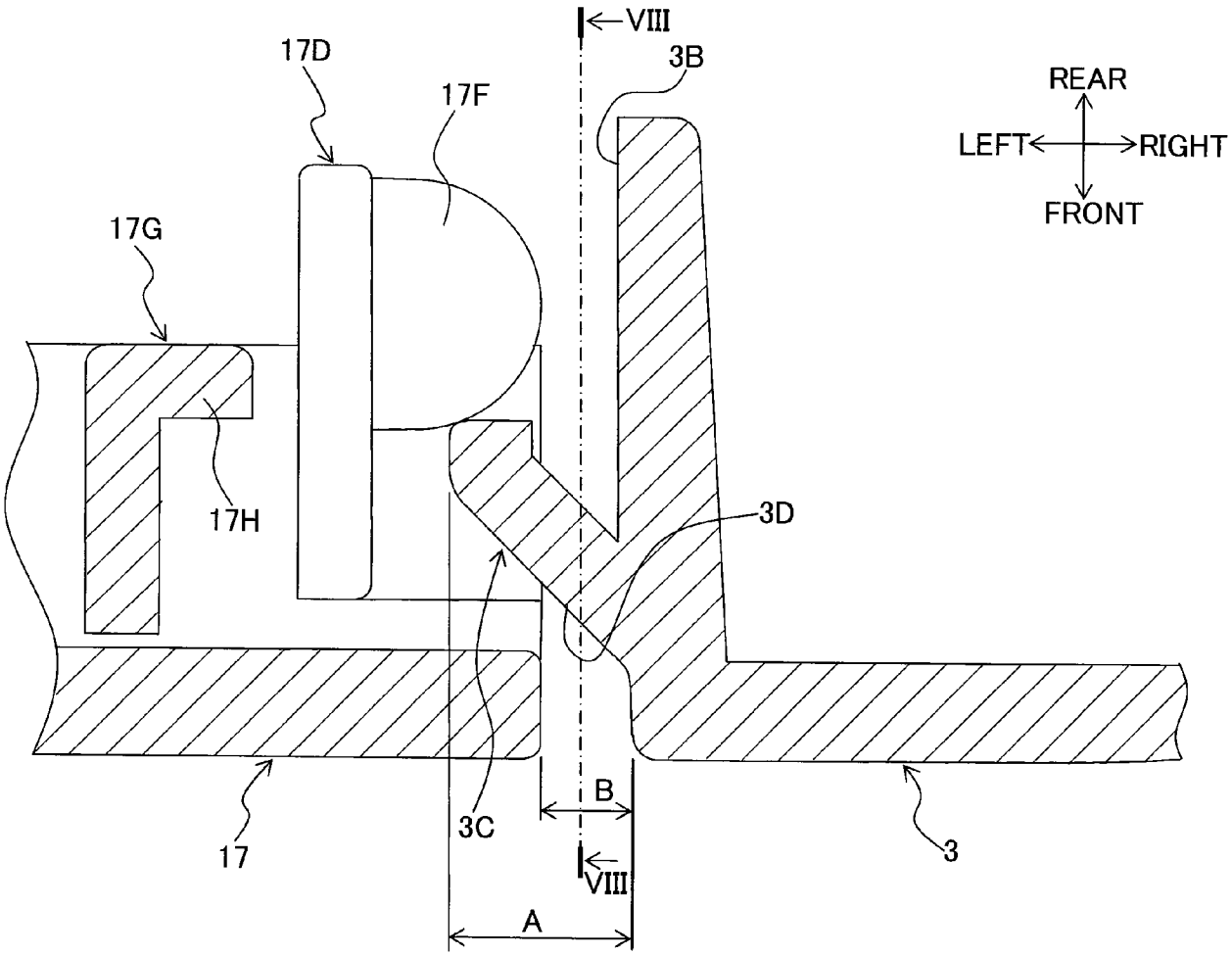
FIG. 6 is a view showing a state in which an engagement projection and a frame-side projection are engaged with each other.
Figure 7A:
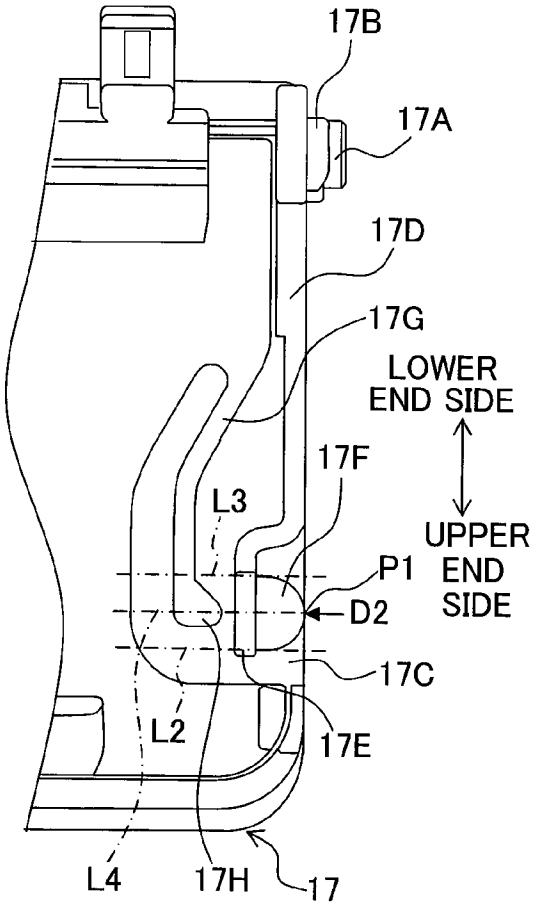
FIG. 7A to FIG. 7C are explanatory views of the deformation and displacement of a first arm and a second arm.

As shown in FIG. 7A, the tip sides of the first arm portions 17D bend inwardly from the outer peripheral edge of the manual feeding tray 17, and on these portions 17E bending inwardly, spherical engagement projections 17F projecting toward the frame surface 3B (see FIG. 6) are provided.

Figure 7B:
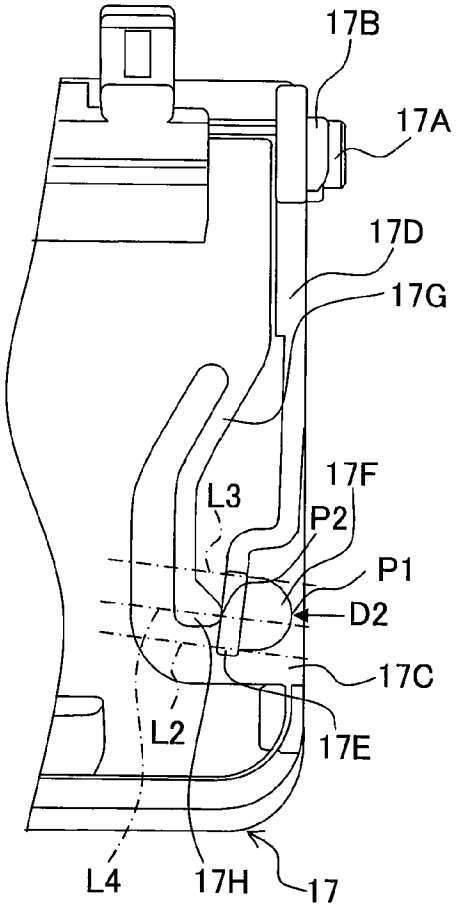
Figure 7C:
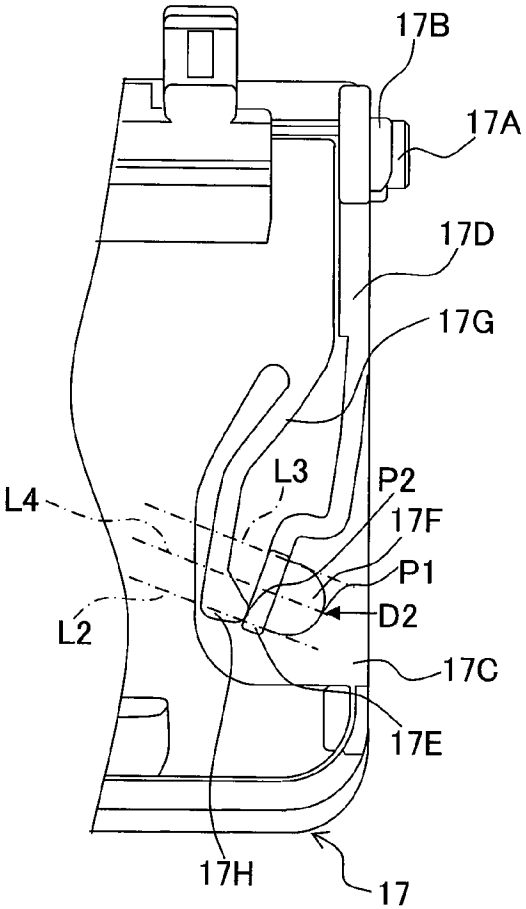

Accordingly, as shown in FIG. 7A to FIG. 7C, the first arms 17D and the engagement projections 17F are constantly located at the inner side of the outer peripheral edge of the manual feeding tray 17, regardless of whether the manual feeding tray 17 is opened or closed.

Further, as shown in FIG. 4A and FIG. 4B, the engagement projections 17F are provided at positions, of the portion 17E, deviated from a center line L1 in extending direction of the first arms 17D toward the image forming part 5, that is, toward the side, of the manual feeding tray 17, where the papers are placed (upper side in FIG. 4A).

Note that "the center line L1 in extending direction of the first arm 17D" refers to a virtual line connecting centroids of cross sections, of the first arm 17D, orthogonal to the extending direction, and "the centroid" refers to a point of balance of an area moment in the cross section.

Accordingly, when a force in a direction D2 (see FIG. 7A) causing the engagement projections 17F to separate from the frame surface 3B acts on the engagement projections 17F, a twisting moment around the center line L1 and a simple bending moment act on the first arms 17D, and the first arms 17D are elastically deformed by these moments.

Further, as shown in FIG. 6, on portions, of the frame surface 3B, corresponding to the engagement projections 17F, frame-side projections 3C which are engaged with the engagement projections 17F when the manual feeding tray 17 is closed are provided.

Each of the frame-side projections 3C has an inclined surface 3D inclined relative to the frame surface 3B so as to be more apart from the frame surface 3B as it goes from a forward (front surface) side toward a backward (rear surface) side of the casing 3, and projects toward the manual feeding tray 17. When the manual feeding tray 17 is closed, tip sides of the frame-side projections 3C are located at the inner side of the outer peripheral edge of the manual feeding tray 17.

That is, a projection size A of the frame-side projections 3C is greater than a distance B from the frame surface 3B to the outer peripheral edge of the manual feeding tray 17. Further, as shown in FIG. 7A, the manual feeding tray 17 has, on inner sides of the first arms 17D, elastically deformable second arms 17G in a substantially down-turn lip shape extending, substantially parallel to the plate surface 17C of the manual feeding tray 17, from the lower end side toward the upper end side of the manual feeding tray 17. Each of the second arms 17G is formed in a cantilever shape with one end sides thereof integrated with the manual feeding tray 17.

Incidentally, the second arms 17G may be made of resin integrally with the first arms 17D to be integrated with the manual feeding tray 17, or may be a member separate from the first arm 17D and attached to be integrated with the manual feeding tray 17.

On portions, of the other end (tip) sides of the second arms 17G, corresponding to the engagement projections 17F, there are provided projections 17H projecting from the second arms 17G toward the first arms 17D.

As shown in FIG. 7B and FIG. 7C, in the second arms 17G, only the projections 17H come into contact with the first arms 17D, so that, when the first arms 17D deform and displace toward the second arms 17G, a force in a direction returning the first arms 17D to the original state (hereinafter, this force will be referred to a restoring force by the second arms 17G) acts on the first arms 17D.

Further, the second arms 17G and the projections 17H are structured such that the projections 17H and the first arms 17D are apart from each other when the first arms 17D are not deformed, as shown in FIG. 7A.

Note that "when the first arms 17D are not deformed" means not only when the first arms 17D are not deformed at all but also includes when the first arms 17D are slightly deformed (for example, when the manual feeding tray 17 is closed or the like).

Figure 8:
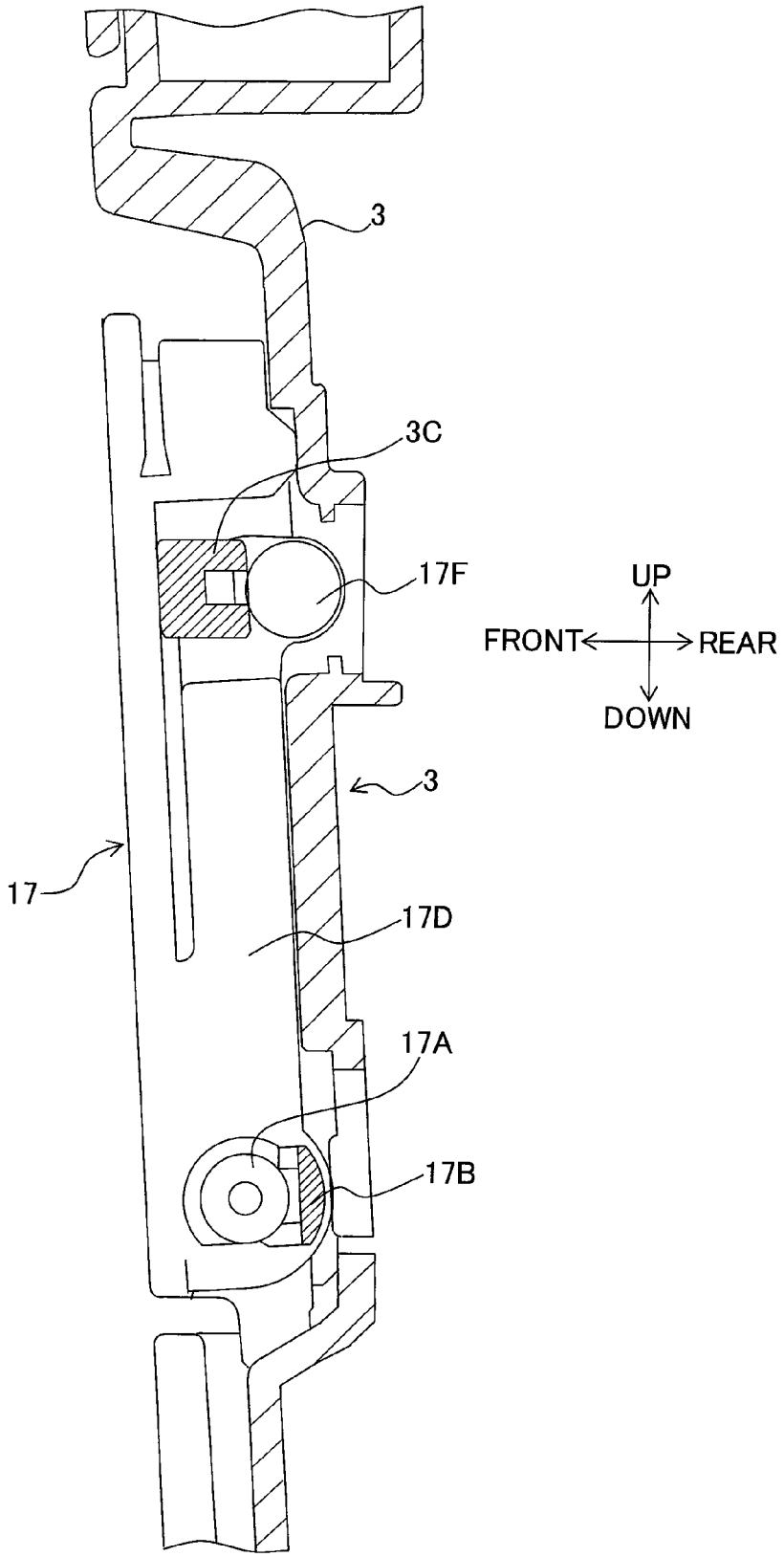
FIG. 8 is a cross sectional view in the state in which the manual feeding tray is closed, taken along VIII-VIII line in FIG. 6.
Figure 9:
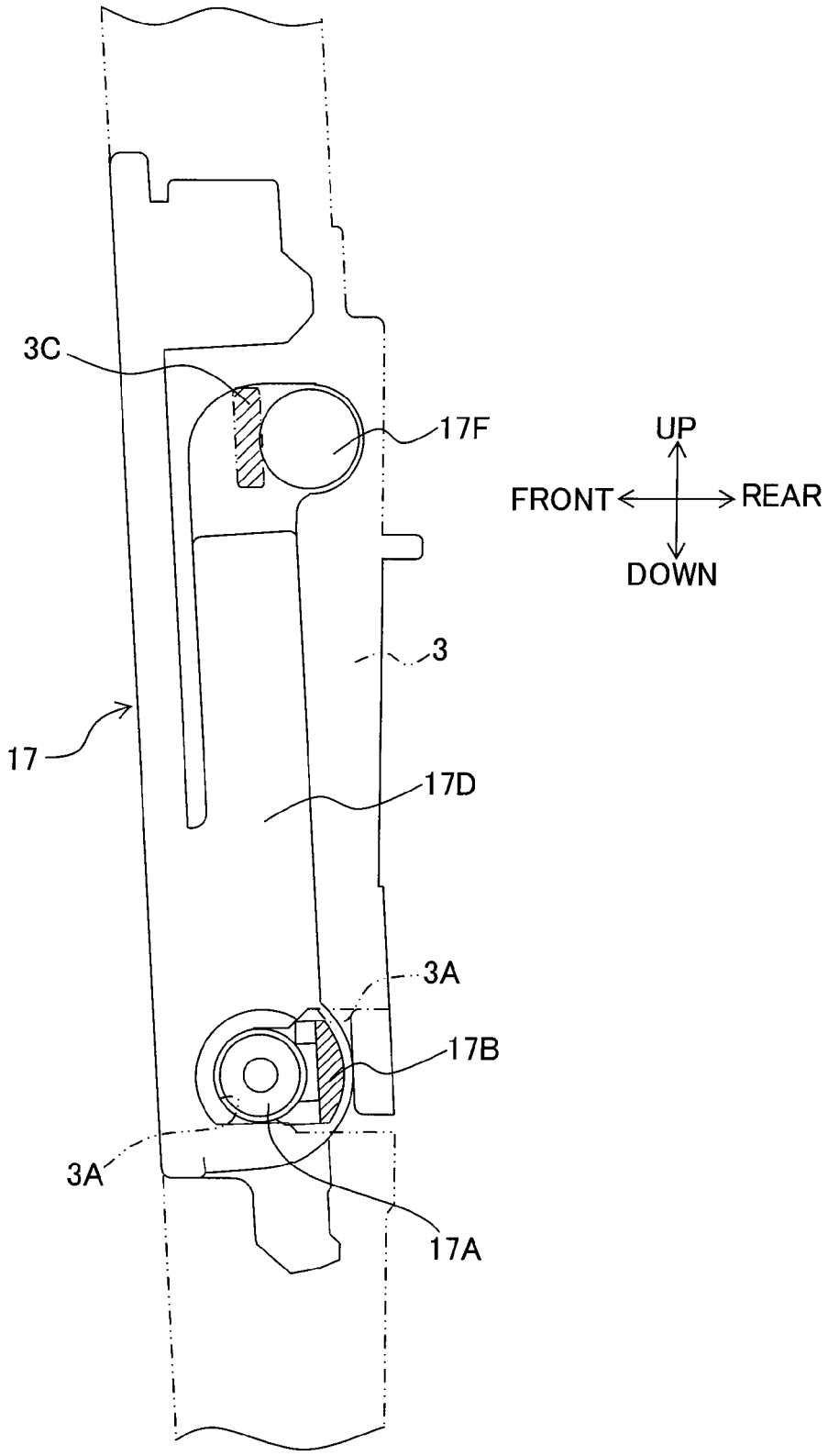
FIG. 9 is a view showing an opening operation of the manual feeding tray and is a view showing the state in which the manual feeding tray is closed.

When the manual feeding tray 17 is closed, the engagement projections 17F and the frame-side projections 3C are engaged as shown in FIG. 6 and FIG. 8 (hereinafter, this state will be referred to as a completely closed state) to keep the manual feeding tray 17 closed and the braking projections 17B are not in contact with the frame surface 3B as shown in FIG. 9, and thus no pivot resistance is generated.

Figure 13A:
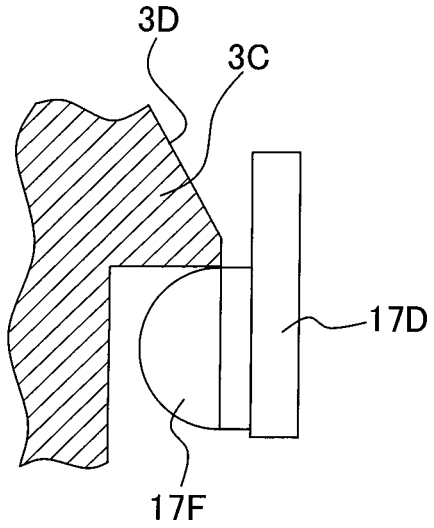
FIG. 13A is a view showing an engagement state of the engagement projection and the frame-side projection.
Figure 13B:
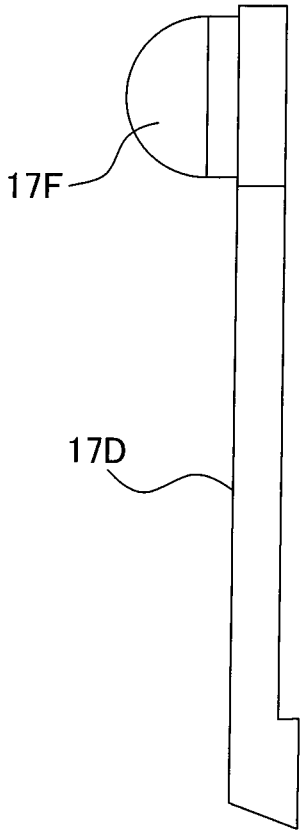
FIG. 13B is a view showing a state of the first arm when the engagement state is in the state shown in FIG. 13A.

In the completely closed state, since almost no twisting moment and almost no bending moment act on the first arms 17D, neither the twisting deformation nor the bending deformation takes place in the first arms 17D as shown in FIG. 13A and FIG. 13B, and the second arms 17G (projections 17H) and the first arms 17D are apart from each other with a predetermined interval as shown in FIG. 7A.

Figure 10:
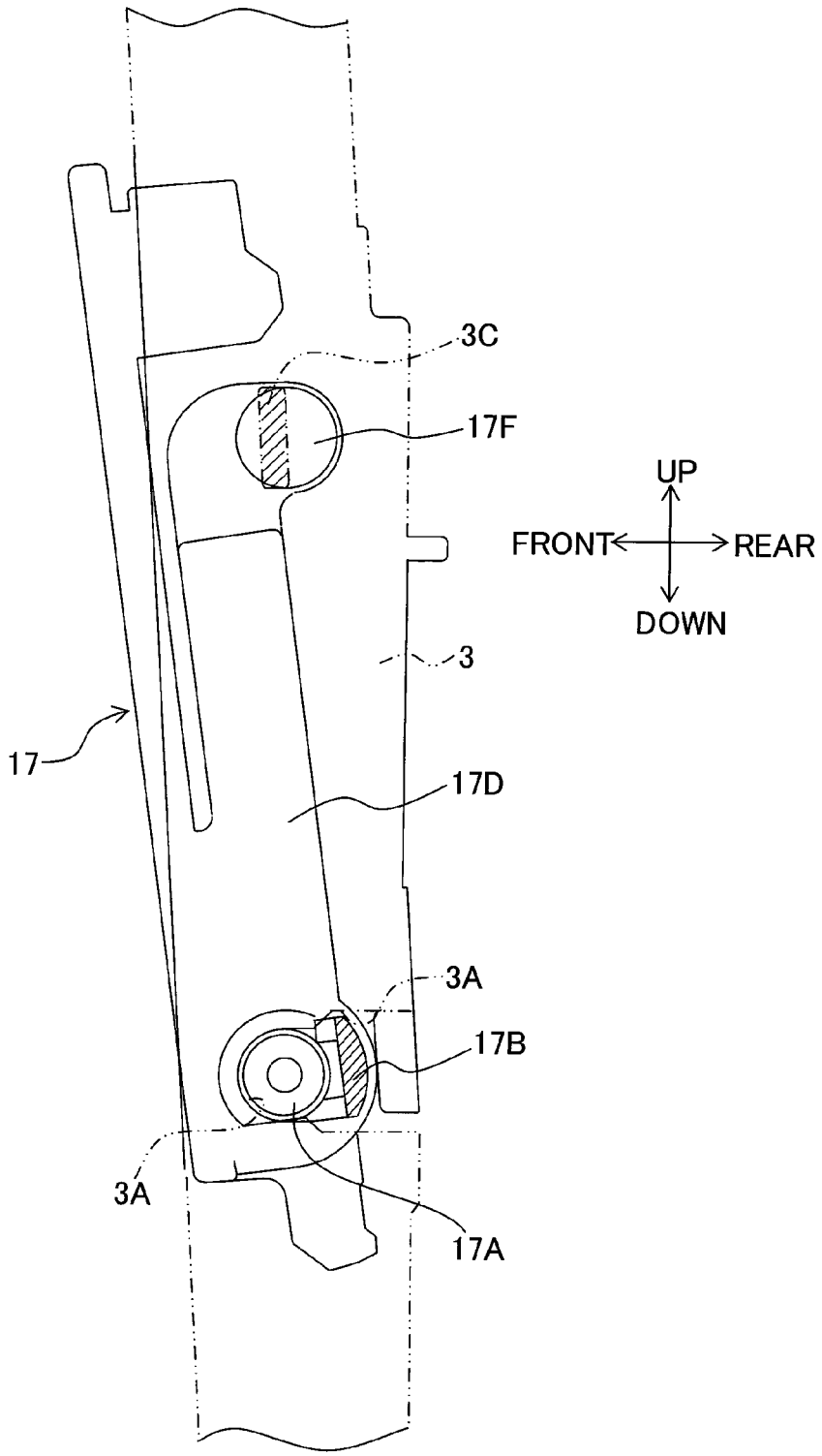
FIG. 10 is a view showing the opening operation of the manual feeding tray and is a view showing a state in which the manual feeding tray begins to open and the engagement projection and the frame-side projection begin to be engaged with each other.
Figure 14A:
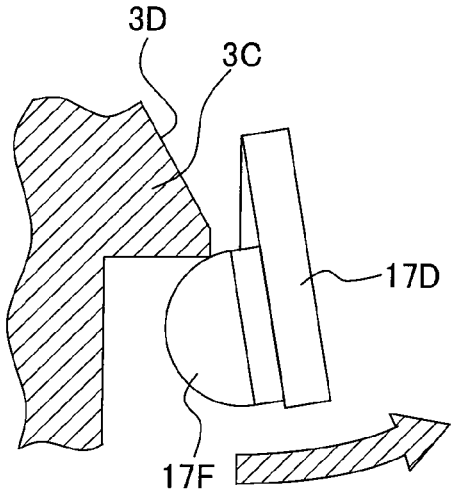
FIG. 14A is a view showing an engagement state of the engagement projection and the frame-side projection.
Figure 14B:
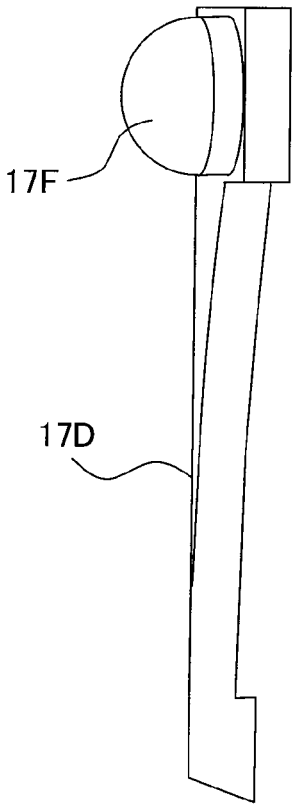
FIG. 14B is a view showing a state of the first arm when the engagement state is in the state shown in FIG. 14A.

Next, in a first initial stage in which the manual feeding tray 17 is opened to such an extent that the braking projections 17B and the frame surface 3B do not come into contact with each other (a stage in which the manual feeding tray 17 shifts from the state in FIG. 9 to the state in FIG. 10), the force acting from the frame-side projections 3C to the engagement projections 17F (hereinafter, this force will be referred to as an external force) acts mainly as the twisting moment on the first arms 17D. Accordingly, the twisting deformation is dominant as the deformation of the first arms 17D as shown in FIG. 14A and FIG. 14B.

Figure 15A:
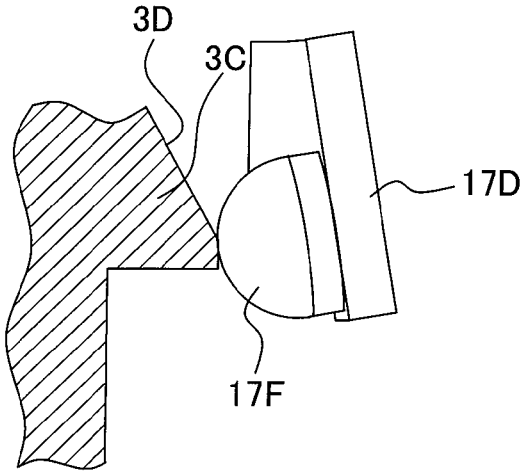
FIG. 15A is a view showing an engagement state of the engagement projection and the frame-side projection.
Figure 15B:
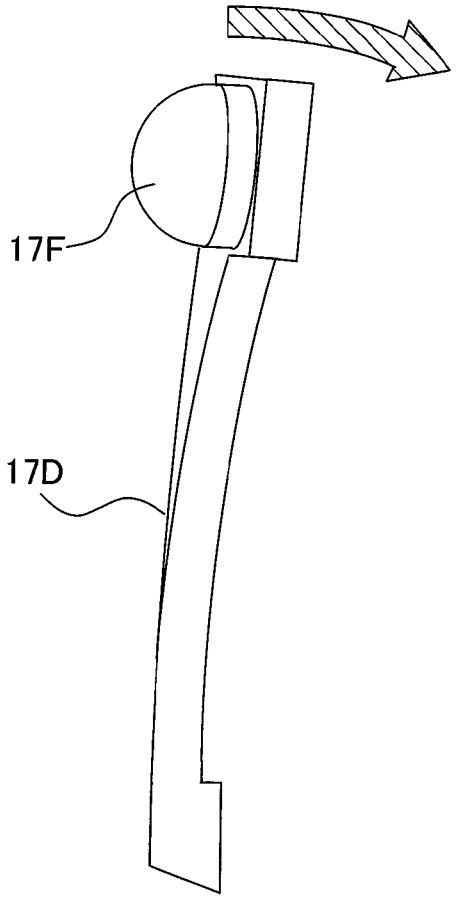
FIG. 15B is a view showing a state of the first arm when the engagement state is in the state shown in FIG. 15A.

Then, when the manual feeding tray 17 is further opened to a state slightly beyond the first initial stage, the external force acts mainly as the bending moment on the first arms 17D. Accordingly, as shown in FIG. 15A and FIG. 15B, the bending (bowing) deformation is dominant as the deformation of the first arms 17D and thus the first arms 17D displace toward the second arms 17G (projections 17H), resulting in a second initial stage in which the second arms 17G and the first arms 17D are in contact with each other, as shown in FIG. 7B.

Next, in a third initial stage in which the manual feeding tray 17 is further opened slightly beyond the second initial stage, the first arms 17D further deform and displace toward the second arms 17G as shown in FIG. 7C. Accordingly, the first arms 17D deform and displace toward the second arms 17G while receiving the restoring force from the second arms 17G.

Figure 11:
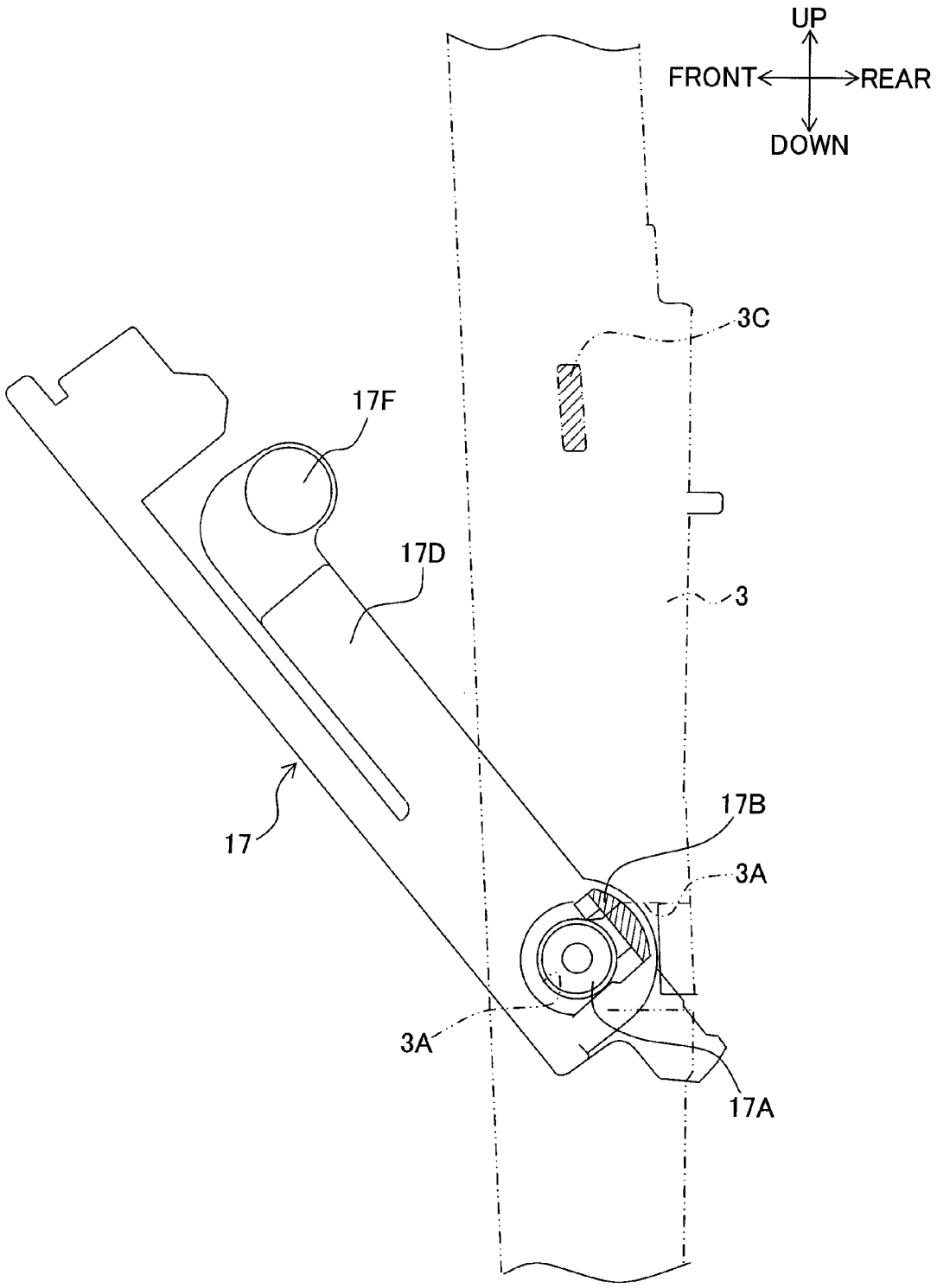
FIG. 11 is a view showing the opening operation of the manual feeding tray and is a view showing a state in which the engagement between the engagement projection and the frame-side projection is released in the course in which the manual feeding tray is opened and a braking projection and a frame surface begin to come into contact with each other.
Figure 12:
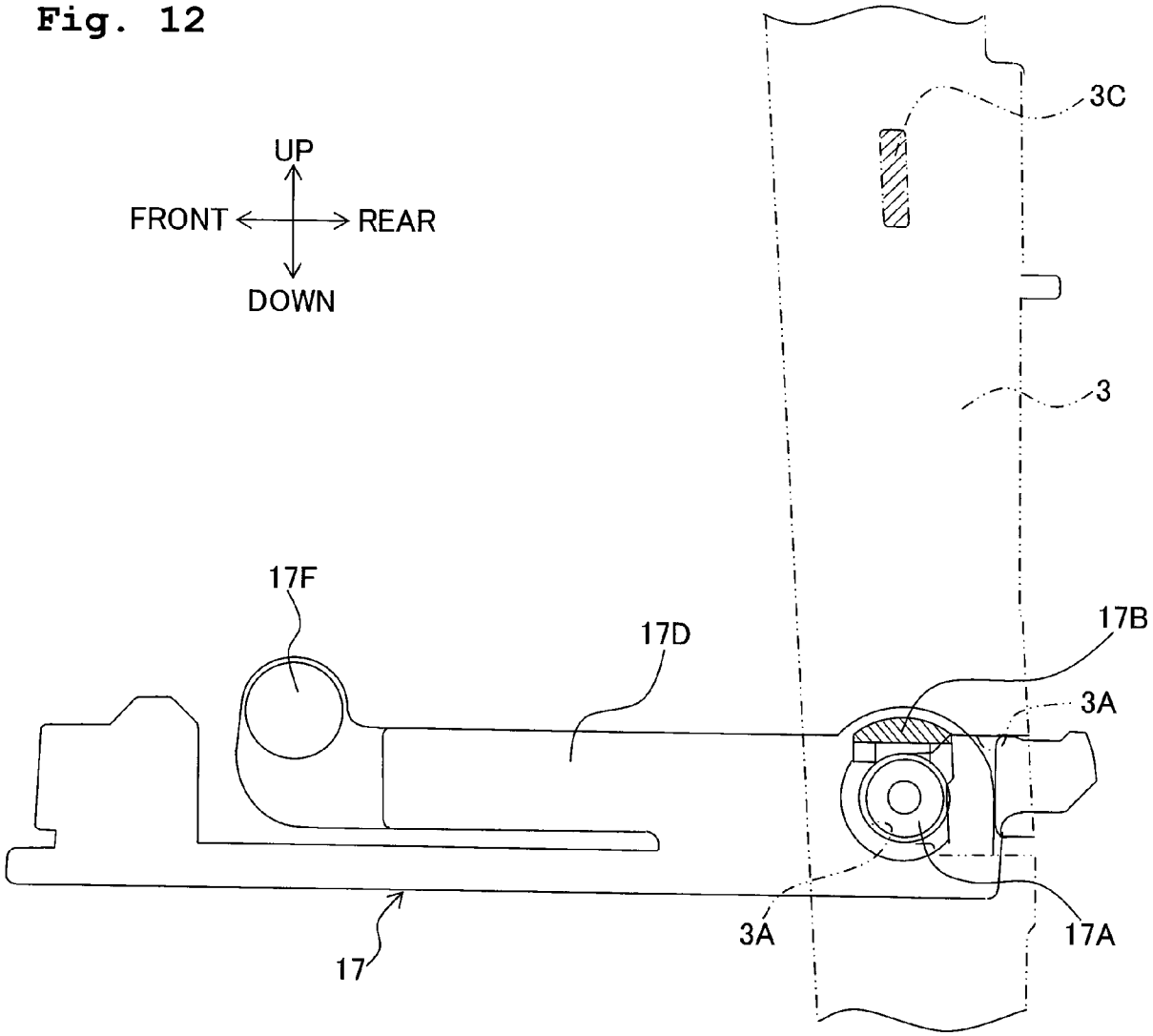
FIG. 12 is a view showing the opening operation of the manual feeding tray and is a view showing a state in which the manual feeding tray is opened.

Then, when the manual feeding tray 17 is further opened from the third initial stage, the engagement projections 17F and the frame-side projections 3C separate from each other as shown in FIG. 11 and FIG. 12, and their engagement is released. Further, the braking projections 17B and the frame surface 3B come into contact with each other to generate a frictional resistance, so that the pivot resistance is generated.

In this embodiment, by changing the elastic forces of the first arms 17D and the second arms 17G which are provided in the manual feeding tray 17, it is possible to easily change the operating force required for a user's opening/closing operation of the manual feeding tray 17. Therefore, it is possible to easily improve the operating feeling.

Specifically, when it is felt that the operating force is excessively large, reducing the elastic force of the second arms 17G can give a better operating feeling. On the other hand, when it is felt that the operating force is excessively small, increasing the elastic force of the second arms 17G can give a better operating feeling. Therefore, it is possible to easily improve the operating feeling.

Here, the elastic force means a stress (restoring force) when a predetermined distortion enabling the elastic deformation occurs. As the distortion, for example, an amount when the deformation of the first elastic portions becomes greatest by the opening/closing of the cover may be adopted and desirably, an amount when the deformation amount is greatest or lower is adopted.

Further, in this embodiment, it is possible to improve operability with a simple structure of providing the second arms 17G in addition to the first arms 17D, without providing any separate component such as a spring.

Incidentally, in this embodiment, the increase in the operating force is realized by setting the elastic force of the second arms 17G greater than the elastic force of the first arms 17D. As a measure for increasing the elastic force of the first arms 17D, it is conceivable to form the first arms 17D with a resin material having a high Young's modulus (hereinafter, this measure will be referred to as a first measure), to increase a second moment of area of the first arms 17D by an increase in a sectional area of the first arms 17D or the like (hereinafter, this measure will be referred to as a second measure), and so on.

However, the first measure is likely to cause a problem such as an increase in manufacturing cost of the image forming apparatus 1 due to a cost increase of the resin material. The second measure requires a larger installation space for the first arms 17D and thus is likely to cause a problem such as an increase in size of the manual feeding tray 17 (image forming apparatus 1).

On the other hand, this embodiment adopts a simple structure of providing the second arms 17G, which makes it possible to improve operability without causing the aforesaid problems. If loading positions of the force that the first arms 17D receive from the frame-side projections 3C are greatly apart from application positions of the force that the second arms 17G apply to the first arms 17D (hereinafter, referred to as a force by the second arms 17G), the force by the second arms 17G sometimes cannot be efficiently utilized. In this case, useless stress concentration sometimes occurs on the first arms 17D, and thus the first arms excessively deform, which is likely to give rise to a problem such as whitening.

On the other hand, in this embodiment, as shown in FIG. 7A to FIG. 7C, the second arms 17G apply the force by coming into contact with the portions, of the first arms 17D, corresponding to the engagement projections 17F. Accordingly, it is possible to prevent loading positions P1 of the force that the first arms 17D receive from the frame-side projections 3C from being greatly apart from application positions P2 of the force by the second arms 17G.

Consequently, since it is possible to efficiently utilize the force by the second arms 17G, the first arms 17D are not excessively deformed. Therefore, it is possible to reduce the generation of the useless stress concentration and to reduce the occurrence of the whitening in the first arms 17D due to the stress concentration.

Here, the portion, of the first arm 17D, corresponding to the engagement projection 17F refers to an area that is sandwiched between a dashed line L2 and a dashed line L3 when seen in a direction orthogonal to the shaft 17A (vertical direction on the paper) and that is on a rear side of the engagement projection 17F (opposite side of the engagement projection 17F with respect to the portion 17E), as shown in FIG. 7A to FIG. 7C.

Incidentally, in this embodiment, the area sandwiched between the upper end side of each of the engagement projections 17F (dashed line L2) and the lower end side thereof (dashed line L3) is the portion corresponding to the engagement projection 17F, and when seen in a projection direction L4 of the engagement projection 17F, the engagement projection 17F and the application position P2 overlap with each other.

Incidentally, the second arms 17G preferably abut on the portions corresponding to the engagement projections 17F at least when beginning to abut on the first arms 17D, and also preferably continue to abut on the portions until the engagement of the first arms 17D and the frame-side projections 3C is released.

Further in this embodiment, the portions (projections 17H), of the second arms 17G, applying the force to the first arms 17D are apart from the first arms 17D when the first arms 17D are not deformed. Therefore, when the displacement of the first arms 17D is small, the operating force depends mainly on the restoring force (elastic force) of the first arms 17D, and when the displacement of the first arms 17D further increases from this state, the operating force depends mainly on the restoring force of the first arms 17D themselves and the restoring force (elastic force) of the second arms 17G.

Accordingly, in this embodiment, since it is possible to set an initial operating force small while setting the operating force thereafter greater than the initial operating force, it is possible to easily improve the operating feeling when the manual feeding tray 17 is opened.

Further, in this embodiment, since the first arms 17D and the second arms 17G are formed by resin molding, positively providing a gap between the projections 17H and the first arms 17D makes it possible to absorb size variation occurring at the time of the resin molding.

Further, in this embodiment, since the engagement projections 17F are provided at the positions deviated from the center line L1 parallel to the first arms 17D, the twisting moment acts on the first arms 17D due to the reactive force received by the first arms 17D from the frame-side projections 3C, as previously described.

Therefore, when the deformation of the first arms 17D is in the first initial stage, the twisting deformation is dominant as the deformation, and in the second initial stage, the bending (bowing) deformation is dominant as the deformation due to the bending moment.

In this embodiment, since it is possible to set an initial operating force small while setting the operating force thereafter greater than the initial operating force, it is possible to easily improve the operating feeling when the manual feeding tray 17 is opened.

Further, in this embodiment, the manual feeding tray 17 is formed substantially in a plate shape, and further, the first arms 17D extend substantially parallel to the plate surface 17C of the manual feeding tray 17. Therefore, it is possible to prevent an increase in thickness (in this embodiment, a front-to-rear direction size) of the manual feeding tray 17 and the portion, of the casing 3, at which the manual feeding tray 17 is attached.

Further, in this embodiment, since the second arms 17G are provided in a member at which the first arms 17D are provided, the structure of a locking mechanism composed of the first arms 17D, the second arms 17G, the frame-side projections 3C, and the engagement projections 17F can be made simple.

Further, in this embodiment, since the first arms 17D, the engagement projections 17F, and the second arms 17G are structured so as to be located on the inner side of the outer peripheral edge of the manual feeding tray 17, a cover-side locking mechanism composed of the first arms 17D, the second arms 17G, and the engagement projections 17F is housed in the manual feeding tray 17. Therefore, it is possible to improve the aesthetic appearance of the outer design surface of the manual feeding tray 17 while reducing the outside size of the manual feeding tray 17.

Further, in this embodiment, since the braking projections 17B giving the pivot resistance to the manual feeding tray 17 are provided, it is possible to prevent the manual feeding tray 17 from pivoting and displacing at an excessively high speed even when a user applies an excessively great operating force to the manual feeding tray 17. Accordingly, it is possible to improve operability of the manual feeding tray 17.

Further, in this embodiment, after the engagement projections 17F and the frame-side projections 3C are apart from each other so that their engagement is released, the braking projections 17B and the frame surface 3B come into contact with each other to generate the frictional resistance and the pivot resistance is generated. This makes it possible to surely prevent the manual feeding tray 17 from being pivoting and displacing at an excessively high speed.

In this embodiment, the manual feeding tray 17 corresponds to a cover described in the claims, the first arm 17D corresponds to a first elastic portion described in the claims, the second arm 17G corresponds to a second elastic portion described in the claims, the engagement projection 17F corresponds to an engage-objective portion described in the claims, and the frame-side projection 3C corresponds to an engaging portion described in the claims.

In the above-described embodiment, the first arms 17D and the second arms 17G are formed in the arm shape extending from the lower end side to the upper end side of the manual feeding tray 17, but the present invention is not limited to this.

For example, the first arms 17D and the second arms 17G may be formed in the arm shape extending from the upper end side to the lower end side of the manual feeding tray 17, respectively.

Further, in the above-described embodiment, the first arms 17D and the second arms 17G are both provided in the manual feeding tray 17, but the present invention is not limited to this. Other possible structures may be, for example, to provide both the first arms 17D and the second arms 17G in the casing 3, to provide the first arms 17D in the manual feeding tray 17 and provide the second arms 17G in the casing 3, to provide the second arms 17G in the manual feeding tray 17 and provide the first arms 17D in the casing 3, and the like.

Further, in the above-described embodiment, the portions (projections 17H), of the second arms 17G, applying the force to the first arms 17D are apart from the first arms 17D when the first arms 17D are not deformed, but the present invention is not limited to this, and the projections 17H may be constantly in contact with the first arms 17D.

Further, in the above-described embodiment, the second arms 17G apply the force by coming into contact with the portions, of the first arms 17D, corresponding to the engagement projections 17F, but the present invention is not limited to this, and the second arms 17G may apply the force by coming into contact with positions deviated from the portions corresponding to the engagement projections 17F.

Further, in the above-described embodiment, the first arms 17D and the second arms 17G extend from the lower end side toward the upper end side of the manual feeding tray 17, but the present invention is not limited to this, and the first arms 17D and the second arms 17G may extend in a direction intersecting with the plate surface 17C of the manual feeding tray 17 or in a direction extending from the upper end side toward the lower end side of the manual feeding tray 17.

Further, in the above-described embodiment, the pivot shafts 17A are provided on the lower end sides, in the longitudinal direction, of the manual feeding tray 17, but the present invention is not limited to this, and the pivot shafts 17A may be provided, for example, on the upper end sides, in the longitudinal direction, of the manual feeding tray 17.

Further, in the above-described embodiment, the present invention is applied to the manual feeding tray 17, but the present invention is not limited to this, and is also applicable to other pivotable covers. Further, the exposure unit 9 according to the above-described embodiment is formed by using the LEDs, but the present invention is not limited to this, and the exposure unit 9 may be an exposure unit exposing the photosensitive drum 7A while scanning the photosensitive drum 7A with a laser beam.

Further, in the above-described embodiment, the present invention is applied to the laser printer of the direct tandem type, but the application of the present invention is not limited to this, and the present invention is also applicable to an electrophotographic-type monochrome image forming apparatus, an intermediate transfer-type color laser printer, and the like.

Further, the present invention may be any provided that it conforms with the spirit of the present invention described in the claims and is not limited to the above-described embodiment.

What is claimed is:

1. An image forming apparatus which forms an image with an image forming section, the apparatus comprising:

a casing in which the image forming section is arranged;

a cover which is displaceably attached to the casing;

a first elastic portion which is elastically deformable, and which is provided on one of the casing and the cover, the first elastic portion having an engage-objective portion which is engageable with an engaging portion provided on the other of the casing and the cover; and a second elastic portion which is elastically deformable, and which applies, to the first elastic portion, a force in a direction returning the first elastic portion to an original state when the first elastic portion is deformed, wherein the first elastic portion is constructed by an arm member having a cantilever shape and has a center line extending in an extending direction of the first elastic portion, and the engage-objective portion is provided at a position deviated from the center line of the first elastic portion in a direction perpendicular to both the extending direction of the first elastic portion and a deformation direction of the first elastic portion toward the second elastic portion.

2. The image forming apparatus according to claim 1, wherein the first elastic portion and the second elastic portion are formed separately.

3. The image forming apparatus according to claim 2, wherein when the first elastic portion is not deformed, a portion, of the second elastic portion, which applies the force to the first elastic portion is apart from the first elastic portion.

4. The image forming apparatus according to claim 1, wherein the second elastic portion applies the force by coming into contact with a portion, of the first elastic portion, corresponding to the engage-objective portion.

5. The image forming apparatus according to claim 1, wherein an elastic force of the second elastic portion is greater than that of the first elastic portion.

6. The image forming apparatus according to claim 1, wherein the cover is formed substantially in a plate shape, and the first elastic portion extends substantially parallel to a plate-shaped surface of the cover.

7. The image forming apparatus according to claim 1, wherein the second elastic portion is provided on one of the casing and the cover on which the first elastic portion is provided.

8. The image forming apparatus according to claim 1, wherein the first elastic portion and the second elastic portion are provided on the cover; and in a state that engagement between the engaging portion and the engage-objective portion is released, the first elastic portion, the engage-objective portion, and the second elastic portion are located on an inner side of an outer peripheral edge of the cover.

9. The image forming apparatus according to claim 1, wherein the cover is pivotally attached to the casing via a pivot shaft, and a braking portion applying a pivot resistance to the cover is provided in the vicinity of the pivot shaft.

10. The image forming apparatus according to claim 9, wherein when engagement between the engaging portion and the engage-objective portion is released, the braking portion applies the pivot resistance to greater extent than before the engagement is released.

* * * * *